US006352453B2

(12) United States Patent
Saitoh

(10) Patent No.: US 6,352,453 B2
(45) Date of Patent: Mar. 5, 2002

(54) TERMINAL STRUCTURE FOR A FEMALE CONNECTOR

(75) Inventor: Yasushi Saitoh, Nagoya (JP)

(73) Assignees: Autonetworks Technologies, Ltd., Nagoya; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/793,149

(22) Filed: Feb. 27, 2001

(30) Foreign Application Priority Data

Mar. 3, 2000 (JP) ..... 2000-058332

(51) Int. Cl.[7] ..... H01R 13/187
(52) U.S. Cl. ..... 439/843; 439/852
(58) Field of Search ..... 439/843, 842, 439/852, 851, 495, 260

(56) References Cited

U.S. PATENT DOCUMENTS 4,564,259 A * 1/1986 Vandame ..... 439/852
5,580,272 A * 12/1996 Yamaguchi et al. ..... 439/495
6,042,433 A * 3/2000 Chen ..... 439/852

* cited by examiner

*Primary Examiner*—Tho D. Ta
(74) *Attorney, Agent, or Firm*—Oliff & Berridge, PLC

(57) ABSTRACT

An elastic tongue piece 3 is arranged in an engaging part 2 in which a male terminal 10 can be engaged. The elastic tongue piece 3 is constructed in such a manner that a base end portion 3*b* is fixed to a backward part of an upper wall of the engaging part 2, and a distal end portion extends forward in the engaging part 2 by way of a curved portion 3*c* continued from the base end portion 3*b*. A contact 3*a* is formed at the distal end portion of the tongue piece 3, and at an intermediate position of the tongue piece 3 between the curved portion 3*c* and the contact 3*a*, is provided a fulcrum portion 3*d* which is in contact with a wall face of a lower wall 2*c* of the engaging part 2 and slidable with respect to the wall face. The tongue piece 3 is constructed as to be supported at the fulcrum portion 3*d* against a force in a direction in which the tongue piece is displaced by an insertion of the male terminal.

6 Claims, 4 Drawing Sheets

TERMINAL STRUCTURE FOR A FEMALE CONNECTOR

BACKGROUND OF THE INVENTION

1. Field of the Invention

The present invention relates to a terminal structure which is applied to a connector such as a female connector corresponding to a male connector, a connector for a flat cable or the like.

2. Related Art

Heretofore, there has been commonly known a terminal structure of the above mentioned female connector and the connector for the flat cable which is so constructed that an elastic tongue piece having a contact is disposed in an engaging part in a cylindrical shape in which a male side conductor including a male terminal or a flat cable is adapted to be engaged, and the contact of the tongue piece can be elastically press contacted with the male side conductor to be engaged in the engaging part.

FIG. 6 shows several examples of the structures of the conventional female terminals. A female terminal 101 which is shown in FIG. 6A has an engaging part 102 in a cylindrical shape in which a male terminal (male tab) 100 can be engaged, and a tongue piece 103 whose base end portion 103*b* is continued from a forward end of a lower wall of the engaging part 102 and folded backward therefrom. The tongue piece 103 has a crooked portion in an angled shape to form a contact 103*a* at an apex of the angled shape.

A female terminal 111 which is shown in FIG. 6B has an engaging part 112 in a cylindrical shape in which the male terminal 100 can be engaged, and a tongue piece 113 whose base end portion 113*b* is continued from a backward end of a lower wall of the engaging part 112 and cut out therefrom to extend diagonally forward in an erected manner. A contact 113*a* is provided near a forward end of the tongue piece 113.

A female terminal 121 which is shown in FIG. 6C has an engaging part 122 in a cylindrical shape in which the male terminal 100 can be engaged, and a tongue piece 123 whose base end portion 123*b* is continued from a backward end of an upper wall of the engaging part 122 and extends forward therefrom by way of a curved portion 123*c*. A contact 123*a* is provided near a forward end of the tongue piece 123.

Problems that the Invention is to Solve

In a terminal of miniature size such as a terminal employed in a micro current circuit, it has been a problem that the terminal may be deteriorated because of displacement of a contact position attributed to a minute sliding movement of the terminal which may be generated by an external factor such as a slide, a change of atmospheric temperature or so. In other words, in a connector for an automobile or the like provided with the terminal of miniature size, a contact portion between the male terminal and the female terminal may sometimes minutely slide in a longitudinal direction (back and forth direction) of the terminals or in a direction along a flat face of the male tab perpendicular thereto, resulting in a displacement of the contact position. Since the faces of both the terminals in contact with each other are gas tight, oxidation will be restrained, but the oxidation proceeds with time on other surfaces of the terminals. Therefore, when the contact position has been displaced as described above, such deterioration by the minute slide that the mating terminal may ride on an area on which an oxide film is formed, and may incur a decrease of electrical conductivity (faulty continuity) will be likely to occur.

As a countermeasure for this problem, it is requested that the contact of the tongue piece of the female terminal is made movable following the movement of the male terminal (so as not to be displaced with respect to the male terminal) which is caused by difference in thermal expansion or vibration of an engine, etc. In other words, it is requested that followability of the female terminal with respect to the male terminal is enhanced by making the contact forming portion of the tongue piece easily movable, so that the contact position between the male terminal and the female terminal may not be displaced.

On the other hand, it is also requested to appropriately increase contact load (contact pressure) for the prevention of a defective contact or chattering at the contact portion between the contact of the aforesaid tongue piece and the male terminal.

However, it has been difficult to satisfy both of the above requests at the same time, according to the conventional terminal structures as shown in FIGS. 6A, 6B, and 6C.

Describing more specifically, in the structure as shown in FIGS. 6A and 6B, a length from the base end portion 103*b* (113*b*) of the tongue piece 103 (113) to the contact 103*a* (113*a*) is relatively short, which is advantageous to increase the contact load by a restoring force corresponding to elastic deformation of this portion, when the male terminal is engaged therewith. However it has been difficult to enhance the followability to the movement of the male terminal 100, because the movement of the tongue piece is restricted.

On the other hand, in the structure as shown in FIG. 6C, in contrast with the structures as shown in FIGS. 6A and 6B, a length from the base end portion 123*b* of the tongue piece 123 to the contact 123*a* can be made relatively long, even though the female terminals have almost the same outer dimension. In this manner, the contact forming portion of the tongue piece 123 can easily move in the longitudinal direction of the terminals or in the direction along the flat face of the male tab perpendicular thereto, which is advantageous for enhancing the followability to the movement of the male terminal 100. However, with such a long structure of the tongue piece, the contact load tends to be decreased.

As described above, the increase of both the contact load and the followability of the female terminal to the movement of the male terminal has been a contradiction with each other in the conventional structures, and it has been difficult to satisfy both the requests at the same time.

SUMMARY OF THE INVENTION

In view of the above described circumstances, it is an object of the invention to provide a terminal structure which can satisfy, at the same time, both the request for enhancing followability of the contact to the movement of the male side conductor, and the request for increasing the contact load with respect to the male side conductor.

Means for Solving the Problems

According to the invention, there is provided a terminal structure comprising an engaging part in a cylindrical shape which has at its forward end an opening for inserting a male side conductor so that the male side conductor can be engaged in the engaging part, and an elastic tongue piece having a contact which is arranged inside the engaging part so that the male side conductor to be engaged in the engaging part can be brought into contact with the contact of the tongue piece, characterized in that the elastic tongue piece is so constructed that its base end portion is fixed to a backward area of the engaging part, its distal end portion extends toward a forward area of the engaging part by way of a curved portion continued from the base end portion, and the tongue piece is provided with the contact at the distal end portion and a fulcrum portion at an intermediate position between the curved portion and the contact, the fulcrum portion being in contact with a wall face of the engaging part and slidable with respect to the wall face, whereby the tongue piece is supported at the fulcrum portion against a force applied in a direction in which the tongue piece is displaced by the insertion of the male side conductor.

With this structure, when the male side conductor is engaged in the engaging part, the contact of the above described tongue piece is pressed by the male side conductor in a direction perpendicular to the inserting direction of the male side conductor (in the longitudinal direction of the terminal: the back and forth direction). On this occasion, the tongue piece is supported at the fulcrum portion against a pressing force, and a portion extending from the fulcrum portion to the contact is elastically deformed to exert a restoring force to the contact portion between the contact and the male side conductor as the contact load. Therefore, the shorter the length from the fulcrum portion to the contact is, the more the aforesaid contact load is likely to be increased.

Moreover, in the engaged state of the male side conductor, when the male side conductor moves in the longitudinal direction of the terminal or in the direction along the flat face of the male tab perpendicular thereto by the difference in the thermal expansion or vibration, etc. with respect to the housing, the contact portion of the tongue piece also moves following the movement of the male side conductor. In this case, the above mentioned fulcrum portion can slide along the wall face of the engaging part, and a portion adapted to be displaced according to the force acting on the tongue piece will be formed at the area of the tongue piece from the base end portion to the contact. The longer this area is made, the more the contact of the tongue piece can easily move.

Therefore, by making the length of the tongue piece from the fulcrum portion to the contact relatively short, the contact load can be appropriately increased, and at the same time, by making the length of the tongue piece from the base end portion to the contact relatively long, the followability to the movement of the male side conductor can be enhanced.

The terminal structure according to the present invention is preferably a structure of a female terminal for conducting electrical connection with a male terminal as the male side conductor, characterized in that the base end portion of the elastic tongue piece is continued from a wall plate of the cylindrical engaging part in which the male terminal is adapted to be engaged, whereby the tongue piece and the engaging part are integrally formed of an electrically conductive metal plate. In this manner, the female terminal having the above described functions can be easily molded.

Further, the terminal structure according to the present invention may comprise a housing constituting the engaging part in which a flat cable as the male side conductor is adapted to be engaged, a slider adapted to be detachably inserted into the housing, and a terminal member having the elastic tongue piece arranged in the housing so that the flat cable may be clamped between the contact at the distal end portion of the tongue piece and the slider, characterized in that the base end portion of the tongue piece is fixed to the housing, and the fulcrum portion to be in contact with a wall face of the housing is provided at the intermediate position of the tongue piece between the curved portion continued from the base end portion and the contact.

In this manner, the contact load with respect to the flat cable as the male side conductor will be increased, and at the same time, the followability to the movement of the flat cable in the longitudinal direction can be enhanced.

DETAILED DESCRIPTION OF THE PREFERRED EMBODIMENTS

Mode for Carrying Out the Invention

Figure 1:
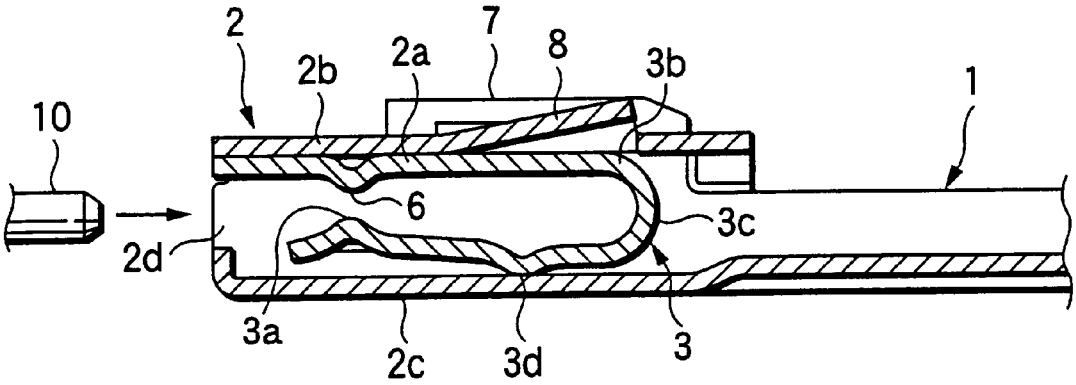
FIG. 1 is a longitudinally sectional view of a terminal illustrating a first embodiment of the invention.

Now, modes for carrying out the present invention will be described referring to the drawings.

Figure 2:
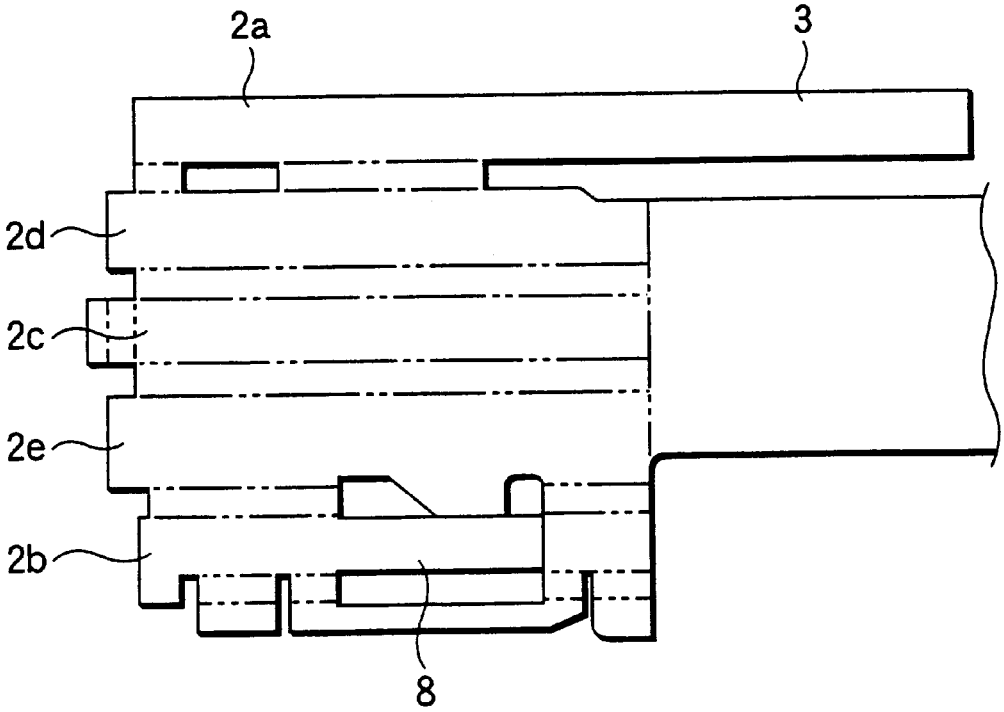
FIG. 2 is a developed view of the above mentioned terminal.
Figure 3:
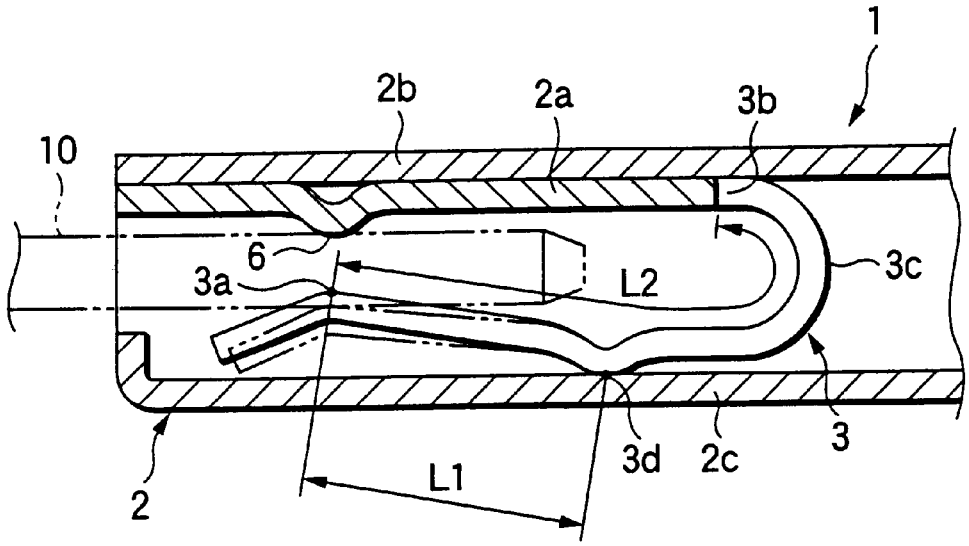
FIG. 3 is a schematic sectional view of an essential part of the above mentioned terminal.

FIGS. 1 to 3 show a structure of a first embodiment in which the present invention is applied to a terminal of a female connector (female terminal) which is adapted to be electrically connected with a terminal of a male connector (a male terminal). FIG. 1 is a sectional view, FIG. 2 is a developed view, and FIG. 3 is a schematic sectional view of an essential part. In these drawings, numeral 1 represents a female terminal provided with an engaging part 2 which can be engaged with a male terminal 10 as the male side conductor, and an elastic tongue piece 3 having a contact 3*a* and disposed in the above mentioned engaging part 2.

The above mentioned engaging part 2 is formed in a substantially columnar shape, and provided with an opening 5 for introducing the male terminal at its forward end. The tongue piece 3 is formed in such a manner that a base end portion 3*b* is positioned in a backward area of the engaging part 2, a portion 3*c* continued from the base end portion 3*b* is curved in the backward area of the engaging part, and a distal end portion extends forward in the engaging part 2 by way of the curved portion 3*c*. A contact 3*a* is formed at the distal end portion of the tongue piece 3. At an intermediate position of the tongue piece between the curved portion 3*c* and the contact 3*a*, is formed a fulcrum portion 3*d* which is in contact with a wall face of the engaging part 2.

Describing more particularly the structure of this female terminal 1, the above mentioned engaging part 2 is composed of an upper wall consisting of a pair of inner and outer wall plates 2*a* and 2*b*, a lower wall 2*c* opposed thereto, and side walls 2*d* and 2*e* which connect the upper wall 2*a*, 2*b* to the lower wall 2*c* at both sides in a lateral direction. The above described tongue piece 3 is formed in such a manner that the base end portion 3*b* is continued from a backward end of the inner wall plate 2*a* of the upper wall of the engaging part 2, and the tongue piece 3 is then curved downward from the backward end of the inner wall plate 2*a*, and extends forward passing nearby the lower wall 2*c*. A determined portion midway of the tongue piece 3 is crooked downward to constitute a fulcrum portion 3*d* which is in contact with the lower wall 2*c* of the engaging part 2.

A distal end portion of the tongue piece 3 ahead of the fulcrum portion 3*d* is crooked in an angled shape making an apex at a portion adjacent to the distal end, and the contact 3*a* is formed at the apex by embossing.

In the developed view as shown in FIG. 2, the side walls 2*d*, 2*e* are connected to both sides of the lower wall 2*c*, and the wall plates 2*a*, 2*b* of the upper wall are connected to respective sides of the side walls 2*d*, 2*e*. The tongue piece 3 is continued from the backward end of the inner wall plate 2*a* of the upper wall to extend backward. A backward extending wire connection part 4 is continued from the backward end of the portion which connects the lower wall 2*c* to the side walls 2*d*, 2*e*. The female terminal 1 as shown in FIG. 1 is formed by stamping out an electrically conductive metal plate in such a developed shape, and then, by conducting bending work.

Moreover, an emboss 6 is formed on the inner wall plate 2*a* of the upper wall of the engaging part 2 at a position facing with the contact 3*a* of the tongue piece 3 for enabling the male terminal 10 inserted into the engaging part 2 is adapted to be clamped between the emboss 6 and the contact 3*a*. The outer wall plate 2*b* of the upper wall of the engaging part 2 is provided with a lance 8 which is adapted to be locked in a cavity of a connector housing which is not shown, and a member 7 for protecting the lance so as to project outwardly.

According to the structure of the first embodiment as described above, when the male terminal 10 has been inserted into the engaging part 2 and clamped between the upper wall of the engaging part 2 and the contact 3*a* of the tongue piece 3, the contact 3*a* of the tongue piece 3 is pressed downward by the male terminal 10. On this occasion, the tongue piece 3 is supported at the fulcrum portion 3*d* against the pressing force, and a restoring force corresponding to an elastic deformation of the area from the fulcrum portion 3*d* to the contact 3*a* acts on a contact portion between the contact 3*a* and the male terminal 10 as contact load. In short, a length L1 from the fulcrum portion 3*d* to the contact 3*a* of the tongue piece 3 is related to the above mentioned contact load, and the shorter the length L1 is, the more the contact load will be increased.

Further, in the engaged state of the male terminal, in case where a difference in the thermal expansion has arisen between the housing and the terminal with a change of temperature, or in case where vibration has been received from an engine or so, the male terminal has a tendency of moving relative to the female terminal 1 in the longitudinal direction of the terminal or in various directions on the flat face of the male tab. On such occasions, a force in a direction of the movement of the male terminal will be exerted on the tongue piece 3 through the contact between the male terminal 10 and the contact 3*a*. However, according to the invention, because the fulcrum portion 3*d* can easily slide along the wall face of the lower wall 2*c*, the portion of the tongue piece 3 from the base end portion 3*b* to the contact 3*a* can be deformed according to the force acting in the direction of the movement of the male terminal, hence, enabling the contact 3*a* of the tongue piece 3 to move following the movement of the male terminal 10. In short , the length L2 of the tongue piece 3 from the base end portion 3*b* to the contact 3*a* is related to the followability of the contact 3*a* t o the movement of the male terminal 10, and the longer is the length L2, the more the followability will be enhanced.

Accordingly, by making the length L1 of the tongue piece 3 from the fulcrum portion 3*d* to the contact 3*a* relatively short, and in contrast, by making the length L2 of the tongue piece 3 from the base end portion 3*b* to the contact 3*a* sufficiently long, the followability of the contact 3*a* to the movement of the male terminal 10 will be enhanced, while the above mentioned contact load will be appropriately increased.

Figure 4:
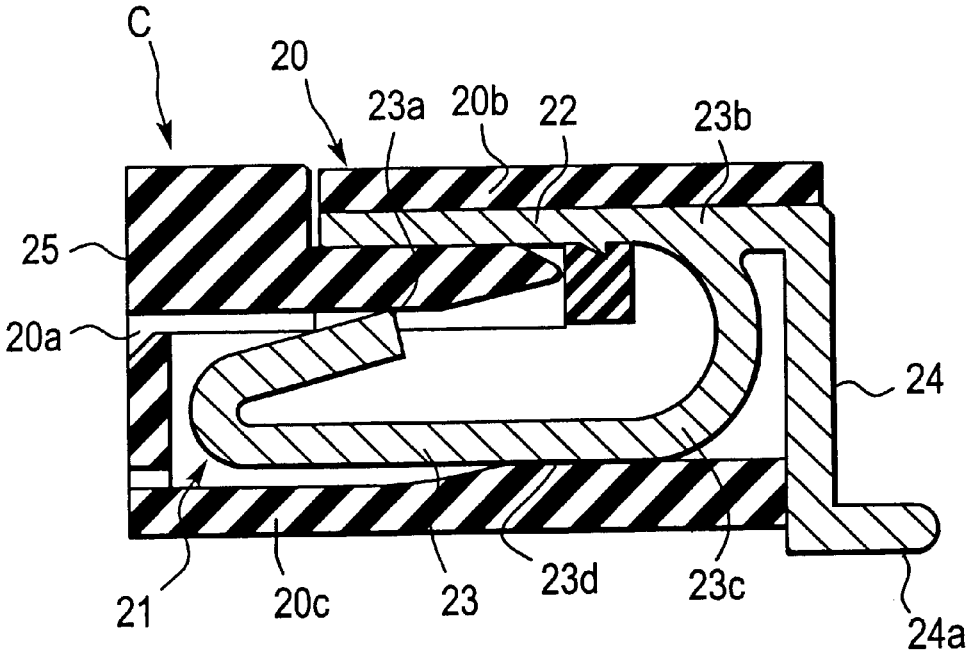
FIG. 4 is a longitudinally sectional view of a connector illustrating a second embodiment of the invention.

FIGS. 4 and 5 show a second embodiment of the terminal structure which is applied to a connector C for connecting and fixing an FFC (Flexible Flat Cable) 30 which is a flat cable having elasticity, on a circuit board.

This connector C includes a housing 20 in which a terminal member 21 having an elastic tongue piece 23 and a slider 25 which can be detachably inserted into the housing 20 are arranged. The above mentioned housing 20 constitutes an engaging part in which the FFC 30 is adapted to be engaged, and is formed in a cylindrical shape having an opening 20*a* into which an end of the FFC 30 and the slider 25 are adapted to be inserted.

The above mentioned terminal member 21 consists of a fixed portion 22 fixed to the housing 20, the elastic tongue piece 23, and a connecting portion 24 for connection to the circuit board, all of which are integrally formed. The fixed portion 22 is anchored and fixed to an upper wall 20*b* of the housing 20.

A base end portion 23*b* of the tongue piece 23 is continued from a backward part of the fixed portion 22, a portion 23*c* continued from the base end portion 23*b* is curved downward, a distal end portion extends forward by way of the curved portion 23*c*, a portion adjacent to the distal end is bent diagonally upwardly in a backward direction, and a contact 23*a* is formed at the distal end. Moreover, in an intermediate part of the lower wall 20*c* of the housing 20 is formed a stepped portion which is higher in a backward side. An intermediate part of the tongue piece 23 comes in contact with this stepped portion thereby to form a fulcrum portion 23*d* at this position.

The connecting portion 24 for the connection to the circuit board is bent downward from the backward end of the aforesaid fixed portion 22, and has a leg portion 24*a* integrally formed at its lower end. When the housing 20 is fixed to the circuit board, the leg portion 24*a* is adapted to be connected to a land on the circuit board by soldering or the like.

The slider 25 can be inserted into the housing 20 through the opening 20*a*, and has a distal end portion formed in a wedge like shape. The FFC 30 is adapted to be clamped between the lower face of the slider 25 and the contact 23*a* of the tongue piece 23, in a state where the slider 25 has been inserted into the housing 20 together with the FFC 30 as described below.

Figure 5A:
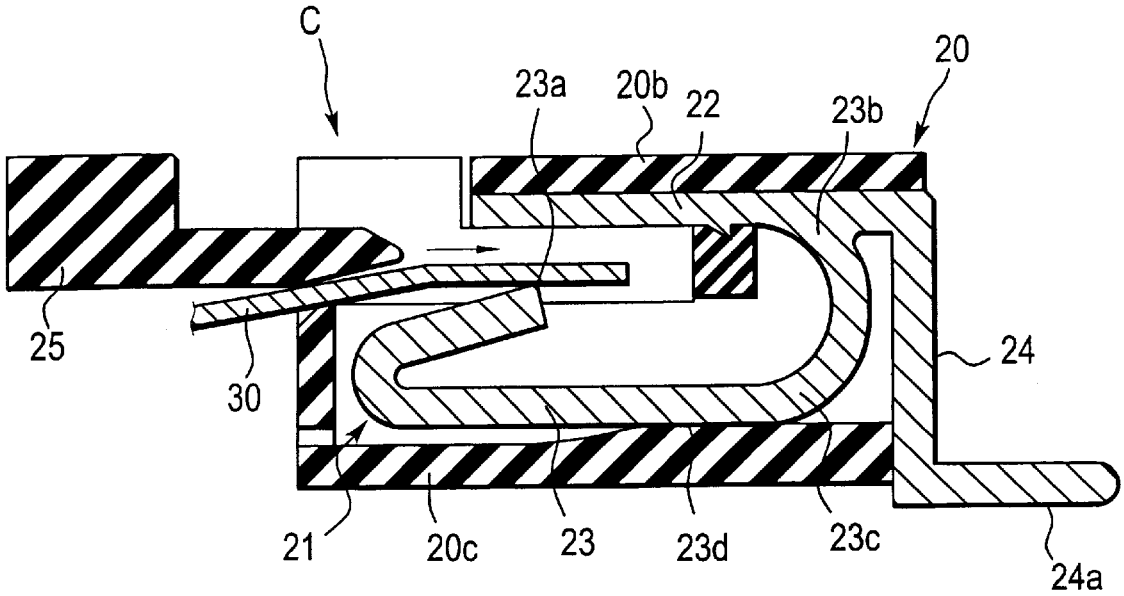
FIG. 5A is a longitudinally sectional view showing a state wherein an FFC is being connected to the above mentioned connector.
Figure 5B:
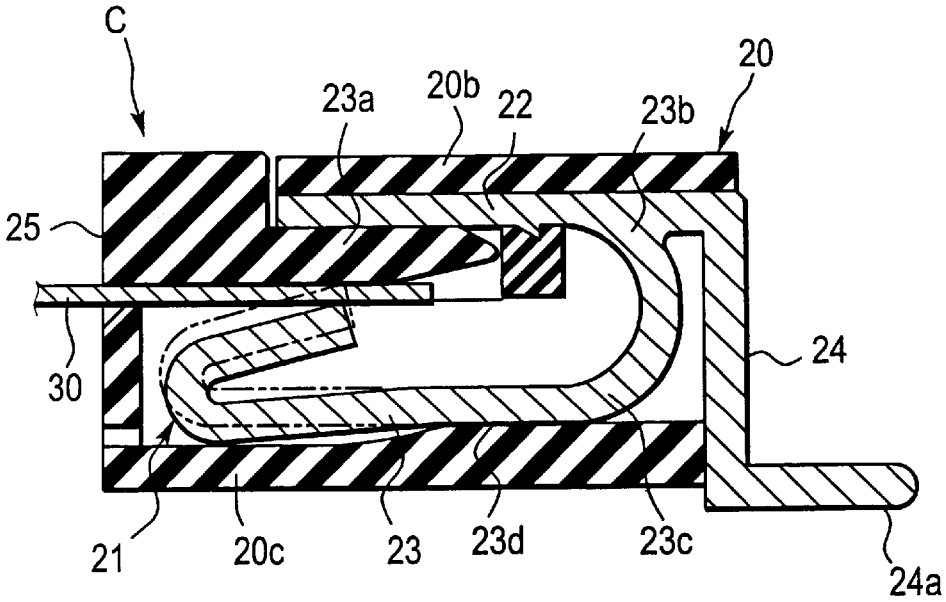
FIG. 5B is a longitudinally sectional view showing a state wherein the connection has been completed.
Figure 6A:
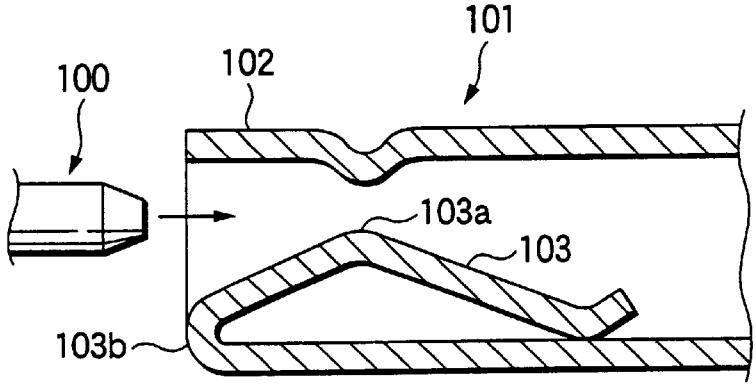
FIGS. 6A, 6B and 6C are respectively schematic sectional views of essential parts of conventional terminal structures.
Figure 6B:
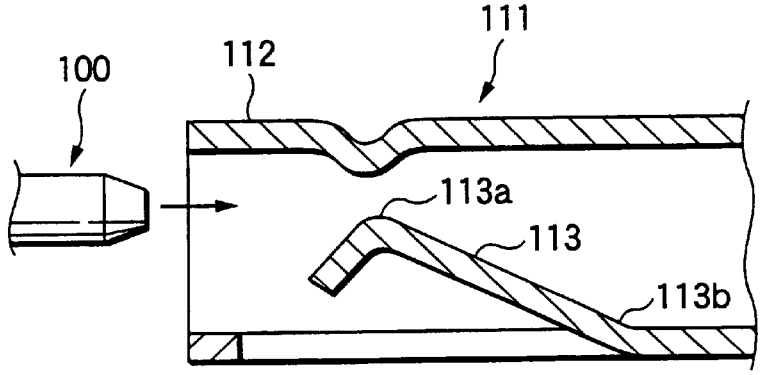
Figure 6C:
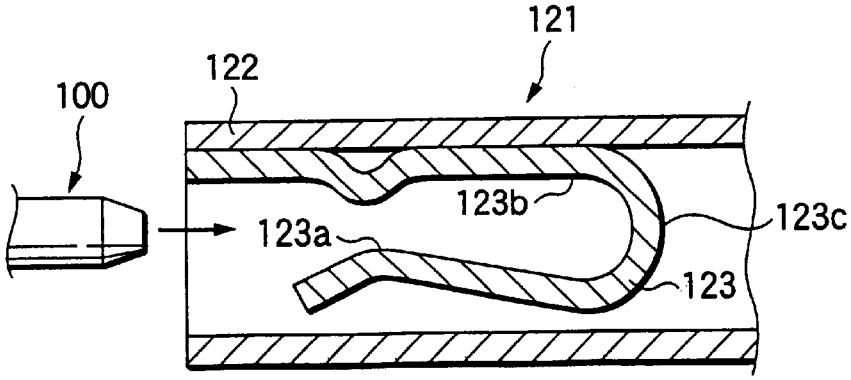

According to the structure of the second embodiment as described above, on occasion of connecting the FFC 30 to the connector C, the slider 25 is drawn out from the housing 20 as a first step as shown in FIG. 5A, and then, the FFC 30 is idly inserted into the housing 20. Thereafter, the slider 25 is inserted between the fixed portion 22 of the terminal and the FFC 30, as shown by an arrow in FIG. 2A. In this manner, the FFC 30 is pressed by the slider 25 as shown in FIG. 5B and held in an elastically contacted state with the contact 23*a* of the tongue piece 23.

Also in this embodiment, the fulcrum portion 23*d* is provided at the intermediate position between the curved portion 23*c* and the contact 23*a* of the tongue piece 23, and the tongue piece 23 is supported at the fulcrum portion 23*d* against a downward force. Therefore, a length of the tongue piece 23 from the fulcrum portion 23*d* to the contact 23*a* is related to the contact load of the contact 23*a* with respect to the FFC 30, and a length of the tongue piece 23 from the base end portion 23*b* to the contact 23*a* is related to followability of the contact 23*a* with respect to movement of the FFC 30.

Accordingly, by making the length of the tongue piece 23 from the fulcrum portion 23*d* to the contact 23*a* relatively short, and in contrast, by making the length of the tongue piece 23 from the base end portion 23*b* to the contact 23*a* sufficiently long, the followability of the contact 23*a* according to the movement of the FFC 30 will be enhanced, while the contact load on the FFC will be increased.

Effects of the Invention

As described herein above, in the terminal structure of the present invention, the elastic tongue piece arranged in the engaging part in which the male side conductor can be engaged is so constructed as to extend forward in the engaging part from the base end portion which is fixed at the backward area of the engaging part by way of the curved portion, and there are formed the contact at the distal end portion of the tongue piece, and the fulcrum portion to be in contact with the wall face of the engaging part at the intermediate position of the tongue piece between the curved portion and the contact. Accordingly, the contact load can be appropriately increased by making the length of the tongue piece from the fulcrum portion to the contact relatively short, and at the same time, the followability of the contact to the movement of the male side conductor can be enhanced by making the length of the tongue piece from the base end portion to the contact relatively long.

Therefore, in case where the terminal is applied to a terminal of miniature size as employed in a micro current circuit or the like, the above described followability can be enhanced while the requested contact load can be obtained, whereby deterioration of the contact portion between the male side conductor and the contact attributed to minute vibration can be restrained.

What is claimed is:

1. A terminal structure, comprising:

an engaging part in a cylindrical shape, with a forward end and a backward end, which has at the forward end thereof an opening for inserting a male side conductor so that said male side conductor is engaged in said engaging part, and an elastic tongue piece having a contact which is arranged inside said engaging part so that said male side conductor to be engaged in said engaging part is brought into contact with said contact of the tongue piece, wherein said elastic tongue piece is so constructed that a base end portion thereof is fixed to said engaging part, a distal end portion thereof extends toward a forward end of the engaging part by way of a curved portion continued from said base end portion, said tongue piece is provided with said contact at said distal end portion and a fulcrum portion, crooked in an angled shape, at an intermediate position between said curved portion and said contact, said fulcrum portion being in contact with a wall face of said engaging part and slidable with respect to said wall face, and said tongue piece is supported at said fulcrum portion against a force applied in a direction in which said tongue piece is displaced by the insertion of said male side conductor.

2. The terminal structure as claimed in claim 1, for which is a female terminal for conducting electrical connection with a male terminal as said male side conductor, wherein said base end portion of said elastic tongue piece is continued from a wall plate of said cylindrical engaging part in which said male terminal is adapted to be engaged, and said tongue piece and said engaging part are integrally formed of an electrically conductive metal plate.

3. The terminal structure as claimed in claim 1, comprising:

a housing constituting said engaging part in which a flat cable as said male side conductor is adapted to be engaged, a slider adapted to be detachably inserted into said housing, and a terminal member having said elastic tongue piece arranged in said housing so that said flat cable is clamped between said contact at the distal end portion of said tongue piece and said slider, wherein said base end portion of said tongue piece is fixed to said housing, and said fulcrum portion to be in contact with a wall face of said housing is provided at the intermediate position of said tongue piece between said curved portion continued from said base end portion and said contact.

4. A terminal structure, comprising:

an engaging part in a cylindrical shape, with a forward end and a backward end, which has at the forward end thereof an opening for inserting a male side conductor so that said male side conductor is engaged in said engaging part, and an elastic tongue piece having a contact which is arranged inside said engaging part so that said male side conductor to be engaged in said engaging part is brought into contact with said contact of the tongue piece, wherein said elastic tongue piece is structured so that a base end portion thereof is fixed to said engaging part, a distal end portion thereof extends toward a forward end of the engaging part by way of a curved portion continued from said base end portion, said tongue piece is provided with said contact at said distal end portion and a fulcrum portion at an intermediate position between said curved portion and said contact, said fulcrum portion being in contact with a stepped portion of a wall face of said engaging part and slidable with respect to said wall face, and said tongue piece is supported at said fulcrum portion against a force applied in a direction in which said tongue piece is displaced by the insertion of said male side conductor.

5. The terminal structure as claimed in claim 4, for which is a female terminal for conducting electrical connection with a male terminal as said male side conductor, wherein said base end portion of said elastic tongue piece is continued from a wall plate of said cylindrical engaging part in which said male terminal is adapted to be engaged, and said tongue piece and said engaging part are integrally formed of an electrically conductive metal plate.

6. The terminal structure as claimed in claim 4, comprising:

a housing constituting said engaging part in which a flat cable as said male side conductor is adapted to be engaged, a slider adapted to be detachably inserted into said housing, and a terminal member having said elastic tongue piece arranged in said housing so that said flat cable is clamped between said contact at the distal end portion of said tongue piece and said slider, wherein said base end portion of said tongue piece is fixed to said housing, and said fulcrum portion to be in contact with a wall face of said housing is provided at the intermediate position of said tongue piece between said curved portion continued from said base end portion and said contact.

* * * * *